US008960975B2

(12) United States Patent
Yang

(10) Patent No.: US 8,960,975 B2
(45) Date of Patent: Feb. 24, 2015

(54) LIGHT-TRANSMITTING CANDLE STRUCTURE

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 36 days.

(21) Appl. No.: 13/802,737

(22) Filed: Mar. 14, 2013

(65) Prior Publication Data

US 2014/0268704 A1 Sep. 18, 2014

(51) Int. Cl.

| | |
|---|---|
| ***F21V 35/00*** | (2006.01) |
| ***F21S 6/00*** | (2006.01) |
| ***F21S 10/04*** | (2006.01) |
| ***G09F 13/00*** | (2006.01) |
| *F21V 23/04* | (2006.01) |
| *F21W 121/00* | (2006.01) |
| *F21Y 101/02* | (2006.01) |
| *F21Y 113/00* | (2006.01) |

(52) U.S. Cl.

CPC ..... *F21S 6/001* (2013.01); *F21S 10/04* (2013.01); *F21V 23/04* (2013.01); *G09F 13/00* (2013.01); *F21W 2121/00* (2013.01); *F21Y 2101/02* (2013.01); *F21Y 2113/005* (2013.01); *Y10S 362/81* (2013.01)

USPC ..... 362/392; 362/351; 362/810

(58) Field of Classification Search

CPC ..... F21S 6/001; F21S 10/04; F21S 10/043; F21S 4/003; F21Y 2101/02

USPC ..... 362/249.06, 392, 351, 806, 810

See application file for complete search history.

(56) References Cited

U.S. PATENT DOCUMENTS

| | | | | |
|---|---|---|---|---|
| 5,664,879 | A * | 9/1997 | Lai | 362/392 |
| 7,314,293 | B2 * | 1/2008 | Steier et al. | 362/351 |
| 2003/0133311 | A1 * | 7/2003 | Robertson et al. | 362/555 |
| 2008/0130266 | A1 * | 6/2008 | DeWitt et al. | 362/96 |
| 2008/0150453 | A1 * | 6/2008 | Medley et al. | 315/312 |
| 2010/0156326 | A1 * | 6/2010 | Chen | 315/313 |

* cited by examiner

*Primary Examiner* — Peggy Neils

(74) *Attorney, Agent, or Firm* — Leong C. Lei

(57) ABSTRACT

The present invention provides a light-transmitting candle structure, which includes a main body, which has a power section for supplying electrical power; a light-emitting unit, which includes two light-emitting element that are mounted on the main body and spaced from each other in a vertical direction and are electrically connected with the power section; a patterned film, which is circumferentially arranged outside and surrounds the light-emitting unit and is coupled to the main body, the patterned film having a surface on which patterns are formed; and a cover, which is a hollow light-transmitting casing having an end forming an opening, the cover having a wall on which a pattern layer is formed, the pattern layer comprising patterns, the cover being set to enclose outside the patterned film and coupled to the main body.

5 Claims, 4 Drawing Sheets

LIGHT-TRANSMITTING CANDLE STRUCTURE

TECHNICAL FIELD OF THE INVENTION

The present invention generally relates to a candle decoration, and more particularly to a decoration that applies light to project patterns on an inner layer onto patterns on an outer layer.

DESCRIPTION OF THE PRIOR ART

Candles are an ancient lighting device. With the creation of various modern lighting devices, candles are nowadays only used for the purposes of creation of romantic atmosphere and in festivals and celebrations. The candles that are currently used are generally of a cylindrical shape and generally no significant change has been made on the outside appearance thereof.

After being lit, the candle flame often shows a floating phenomenon due to air flowing around the candle. When the airflows get excessively strong, the candle may be extinguished. Sometimes, the candle itself may be blown down with the flame still burning, causing the molten wax to widely spill. In case a combustible article is placed around the candle, a fire disaster may occur. An electronic candle provides illumination and decoration. However, the lighting and surface patterns are generally neither luxuriant nor rich. Thus, it is desired to have an electronic candle that provides rich visual effects.

SUMMARY OF THE INVENTION

Thus, the present invention provides a light-transmitting candle structure, which comprises:

a main body, which comprises a power section that is adapted to connect to a battery to receive electrical power;

a light-emitting unit, which comprises two light-emitting elements that are mounted on the main body and spaced from each other in a vertical direction and are electrically connected with the power section;

a patterned film, which is circumferentially arranged outside and surrounds the light-emitting unit and is coupled to the main body, the patterned film having a surface on which patterns are formed; and a cover, which is a hollow light-transmitting casing having an end forming an opening, the cover having a wall on which a pattern layer is formed, the pattern layer comprising patterns, the cover being set to enclose outside the patterned film and coupled to the main body;

whereby the light emitting from the light-emitting unit projects the patterns of the patterned film to the cover for overlapping or staggering with respect to the patterns of the pattern layer on the wall of the cover, allowing the formation of layers of light shades of different depths in the front-rear direction on the cover and thus providing a three-dimensional visual effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
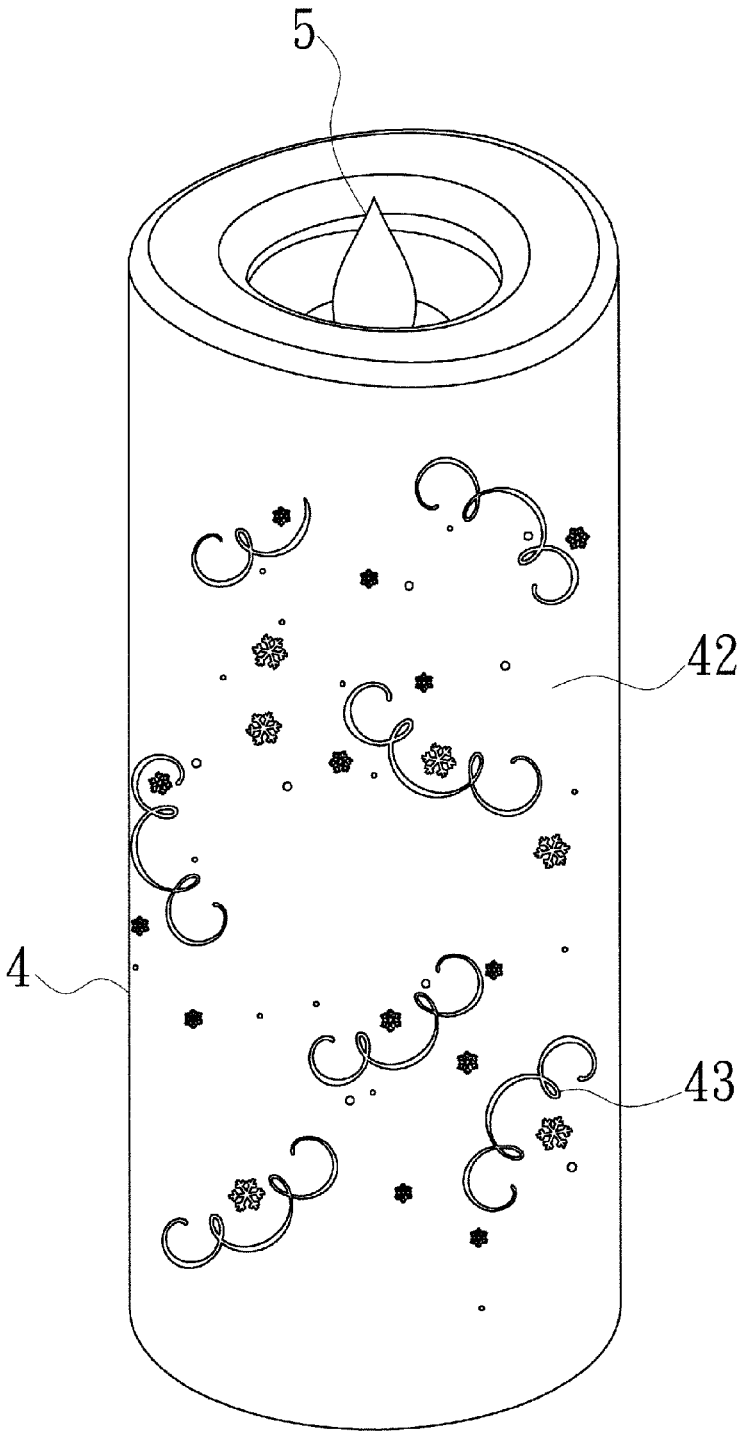
FIG. 1 is a perspective view showing the present invention.
Figure 2:
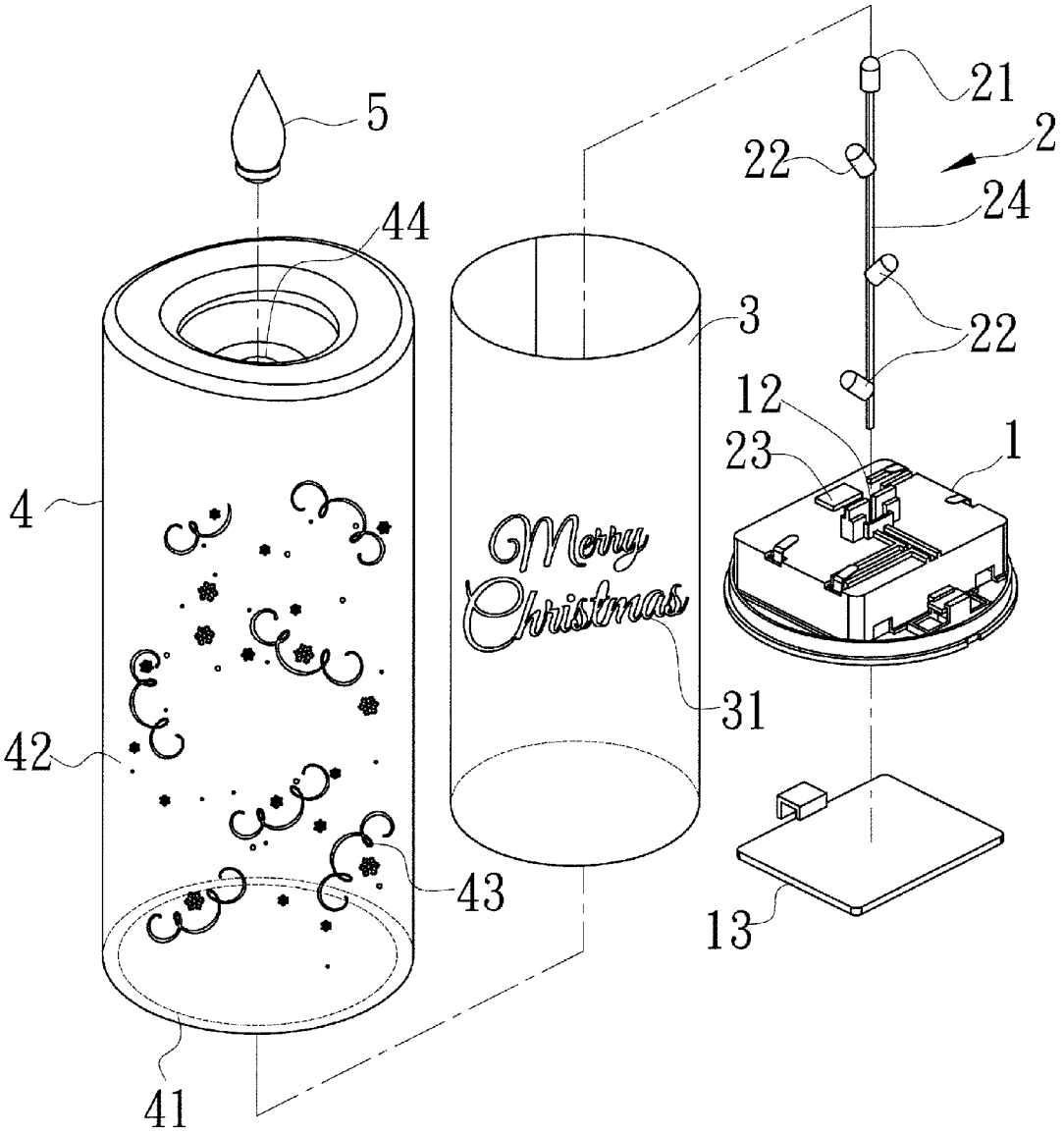
FIG. 2 is an exploded view of the present invention.
Figure 3:
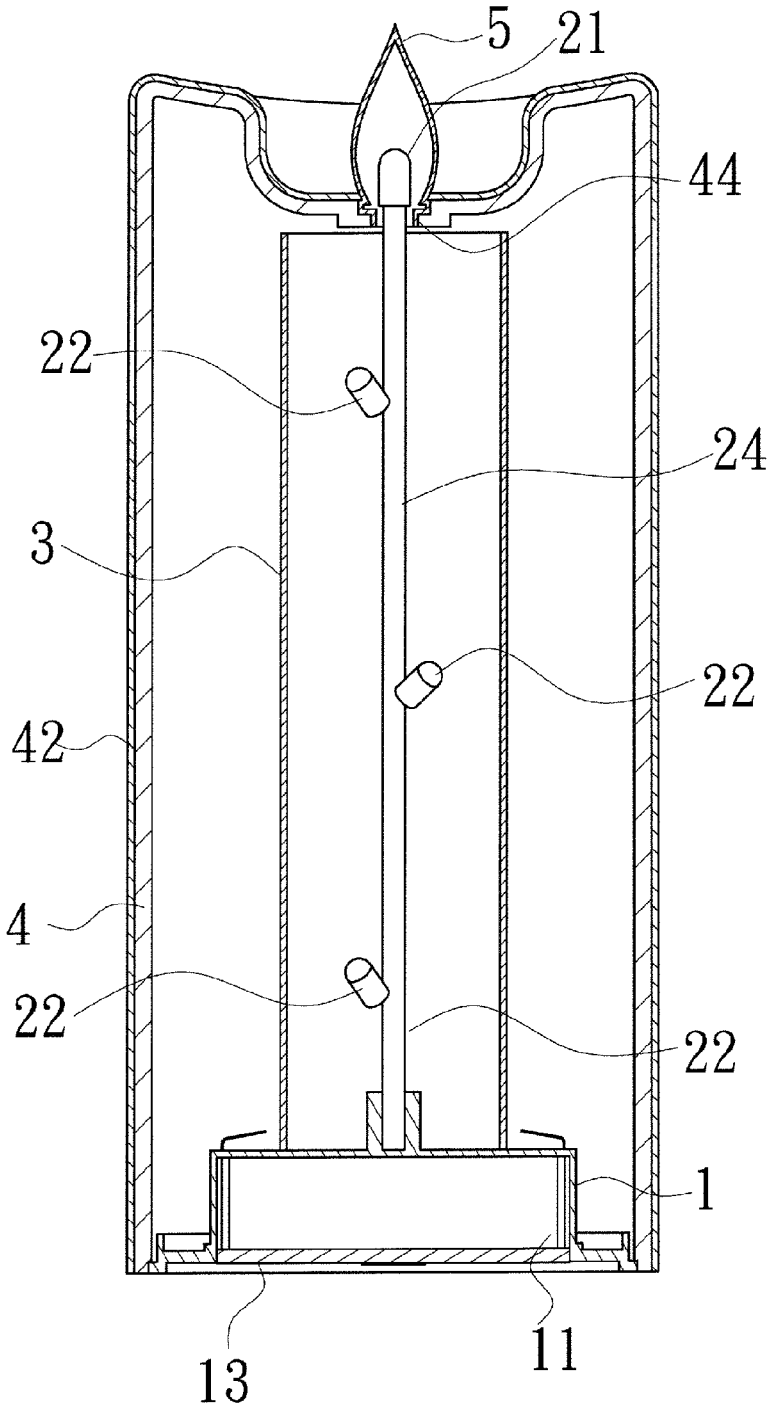
FIG. 3 is a cross-sectional view of the present invention.

Referring to FIGS. 1-3, the present invention provides a light-transmitting candle structure, which comprises the following components:

A main body 1 comprises a power section 11 that is connectable with a battery to supply electrical power. The main body 1 also comprises a retention trough 12. A cover 13 is attached to and covers a bottom of the main body 1.

A light-emitting unit 2 comprises a primary light-emitting element 21, a plurality of secondary light-emitting elements 22, and a circuit board 23. The primary light-emitting element 21 and the secondary light-emitting elements 22 are mounted to a pillar 24 to be spaced from each other in a vertical direction. The pillar 24 is received and fixed in the retention trough 12 of the main body 1. The circuit board 23 is electrically connected to the power section 11 of the main body 1 and controls the primary light-emitting element 21 and the secondary light-emitting elements 22.

A patterned film 3 is circumferentially arranged around the light-emitting unit 2 and is coupled to the main body 1. The patterned film 3 is a flexible plastic sheet having a surface on which patterns 31 are formed.

A cover 4 is a hollow light-transmitting casing having an end forming an opening 41. The cover 4 has a wall on which a pattern layer 42 is formed. The pattern layer 42 comprises patterns 43. The cover 4 is set to enclose outside the patterned film 3 and is coupled to the main body 1.

Figure 4:
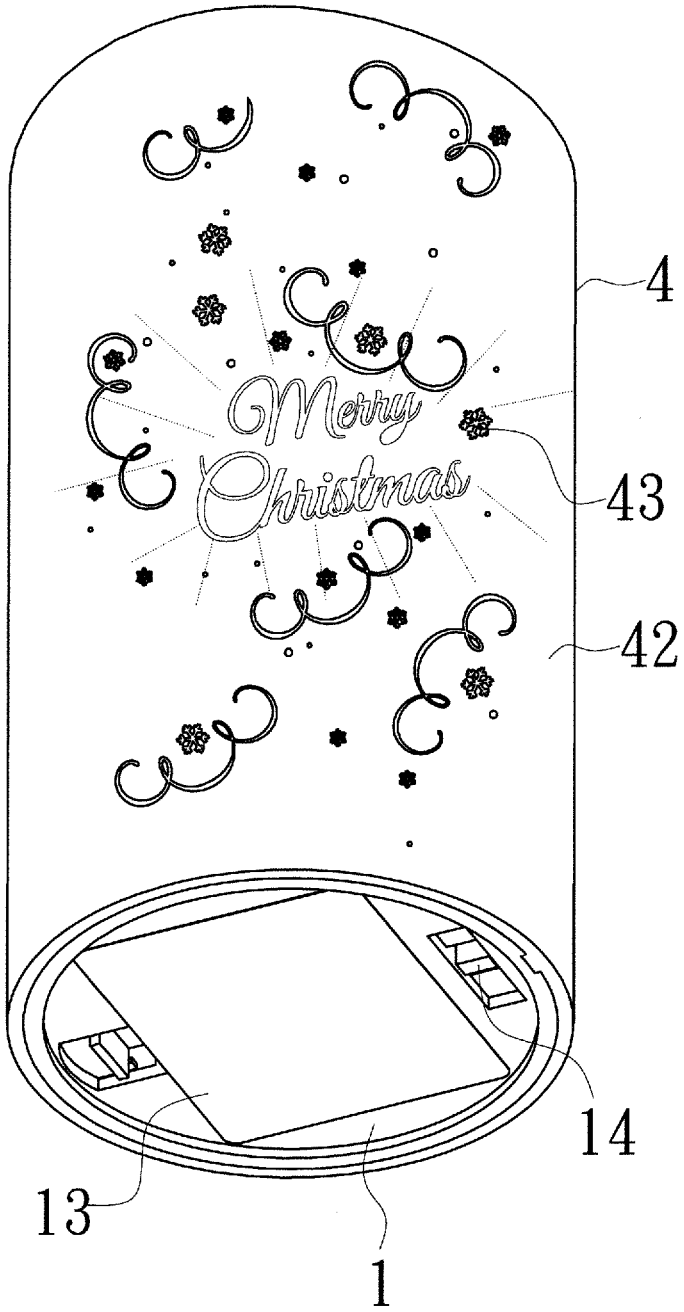
FIG. 4 is a perspective view of the present invention taken from the under side.

As shown in FIG. 4, in the instant embodiment, the main body 1 further comprises a switch 14 that has an end connected to the power section 11 and another end connected to the circuit board 23. The switch 14 is used to control the primary and secondary light-emitting elements 21, 22 to light on/off. The cover 4 has an opening 44 in the top thereof. The primary light-emitting element 21 is mounted on the top of the pillar 24 and partially extends out of the opening 44. The opening 44 receives and retain therein a lampshade 5, which is in the form of a hollow candle flame. In the instant embodiment, the secondary light-emitting elements are color light-emitting diode (LED) lights. The circuit board 23 controls the sequence of color and timing of lighting of the secondary light-emitting elements 22 so as to allow lights of the secondary light-emitting elements 22 to irradiate the patterned film 3 thereby projecting the patterns 31 of the patterned film 3 to the cover 4 for overlapping or staggering with respect to the patterns 43 of the pattern layer 42 on the wall of the cover, allowing the formation of layers of light shades of different depths in the front-rear direction on the cover 4 and providing a three-dimensional visual effect to show environmental lighting of decorative effect.

Further, the pattern layer 42 is formed through sandblasting or frosting and is attached to the wall of the cover 4. The patterns 43 can be of a hollowed form, a colored form, or a form of sticks. The secondary light-emitting elements can be replaced by a light bar to enrich and provide an endless lighting effect.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A light-transmitting candle structure, comprising:

a main body, which comprises a power section that is adapted to connect to a battery to receive electrical power;

a light-emitting unit, which comprises two light-emitting elements that are mounted on a vertically extending pillar that has a lower end received and fixed in a retention trough formed in the main body and spaced from each other in a vertical direction and are electrically connected with the power section, wherein one of the light-emitting elements is mounted to an upper end of the pillar distant from the main body and the remaining one of the light-emitting elements is mounted to a portion of the pillar between the upper and lower ends so as to be spaced from the main body;

a patterned film, which is circumferentially arranged outside and surrounds the light-emitting unit and is coupled to the main body, the patterned film having a surface on which patterns are formed; and a cover, which is a hollow light-transmitting casing having an end forming an opening, the cover having a wall on which a pattern layer is formed, the pattern layer comprising patterns, the cover being set to enclose outside the patterned film and coupled to the main body.

2. The light-transmitting candle structure according to claim 1, wherein the light-emitting unit further comprises a circuit board that is electrically connected to the power section, the circuit board controlling the light-emitting elements.

3. The light-transmitting candle structure device according to claim 1, wherein the cover has an opening formed in a top thereof, the opening receiving and retaining therein a lampshade.

4. The light-transmitting candle structure according to claim 1, wherein the pattern layer is attached outside the wall of the cover.

5. The light-transmitting candle structure according to claim 1, wherein the main body comprises a switch that has an end connected to the power section, the switching controlling the light-emitting unit to light on/off.

* * * * *